United States Patent [19]

Reilard

[11] Patent Number: 4,712,682

[45] Date of Patent: Dec. 15, 1987

[54] ELECTRONIC VALVE CONTROL FOR SLOUGHING MACHINES

[75] Inventor: Ulrich Reilard, Gelsenkirchen, Fed. Rep. of Germany

[73] Assignee: M.A.N.Maschinenfabrik Augsburg-Nürnberg Aktiengesellschaft, Fed. Rep. of Germany

[21] Appl. No.: 784,514

[22] Filed: Oct. 4, 1985

[30] Foreign Application Priority Data

Oct. 9, 1984 [DE] Fed. Rep. of Germany ..... 3437009
Aug. 31, 1985 [DE] Fed. Rep. of Germany ..... 3531240

[51] Int. Cl.[4] ..... B03B 5/20; B03B 5/24

[52] U.S. Cl. ..... 209/455; 209/500; 209/502

[58] Field of Search ..... 209/422, 425, 455, 468, 209/475, 500, 502, 503, 457, 488, 489, 490, 495, 499; 137/624.12, 624.15, 624.2; 251/129.05

[56] References Cited

U.S. PATENT DOCUMENTS

| | | | |
|---|---|---|---|
| 3,285,414 | 11/1966 | Bosman | 209/500 X |
| 3,821,967 | 7/1974 | Sturman et al. | 137/624.15 |
| 3,890,223 | 6/1975 | Stern | 209/500 X |
| 4,019,981 | 4/1977 | Stern et al. | 209/500 X |
| 4,127,480 | 11/1978 | Aldick et al. | 209/502 X |
| 4,336,132 | 6/1982 | Huebner et al. | 209/500 |
| 4,566,487 | 1/1986 | Lotz | 209/502 X |

FOREIGN PATENT DOCUMENTS

| | | | |
|---|---|---|---|
| 2654593 | 8/1980 | Fed. Rep. of Germany . | |
| 0541499 | 3/1977 | U.S.S.R. | 209/500 |

OTHER PUBLICATIONS

"*Pulse, Digital and Switching Waveforms*", Millman and Taub, McGraw-Hill Book Company, 1965, pp. 325-326.

*Primary Examiner*—Randolph A. Reese
*Assistant Examiner*—Edward M. Wacyra
*Attorney, Agent, or Firm*—McGlew and Tuttle

[57] ABSTRACT

An electronic control method and apparatus for controlling the sloughing strokes in sloughing machines for coal and other minerals, has a stroke frequency generator which supplies recurrent signal codes to parallel-connected inlet and outlet stroke generators. Power amplifiers are connected to the stroke generators for amplifying command pulses therefrom, the pulses being supplied to inlet and outlet valves of the machine. A signal code is supplied from the stroke frequency generator through a divisor in a freely selectable clock sequence to the outlet stroke generator or alternatively the divisor releases the command pulse from the outlet stroke generator to the outlet valve in a freely selectable clock sequence. The apparatus for carrying out the control method contains a control unit for each sloughing machine, comprising a freely adjustable stroke frequency generator, a divisor for the adjustable ratio of the number of inlet stroke frequencies to the outlet stroke frequencies, at least one inlet stroke generator, at least one outlet stroke generator and the respective power amplifiers. AND gates can also be used between the frequency generator and the amplifiers. To prolong the opening period of the outlet valve without overlapping the opening period of the inlet valve, for example, there may be connected between the stroke frequency generator and the inlet stroke generator, an AND gate with an inverted input from the divisor.

15 Claims, 4 Drawing Figures

ELECTRONIC VALVE CONTROL FOR SLOUGHING MACHINES

FIELD AND BACKGROUND OF THE INVENTION

The present invention relates to an electronic valve control for controlling the sloughing strokes in wet sloughing machines for coal and other minerals. The control has a stroke frequency generator which supplies recurrent signal codes to inlet and outlet sloughing stroke generators which are connected in parallel, with power amplifiers connected after the stroke generators to produce command pulses for inlet and outlet valves of the sloughing machine.

A method and apparatus for the processing of mineral mixtures, in particular unwashed coal, on an air-controlled wet sloughing machine is known for example from U.S. Pat. No. 4,019,981. In this reference a separating liquid is moved up and down periodically through the openings of the sloughing material support with the aid of control waves arranged in air and/or separating liquid feed lines. The pulsing movement of the separating liquid is effected by means of an electronic valve pulse control of compressed air supplied to the sloughing machine and/or by means of the separating liquid quantity supplied.

This known electronic valve pulse control, however, is not suitable for a valve control in sloughing machines which have one valve per sloughing chamber for the control of additive strokes and one valve for the control of the air outlet (German Pat. No. 26 54 593).

SUMMARY OF THE INVENTION

It is the object of the present invention to provide a new electronic valve control which is suitable for the control of the air inlet and outlet valves in known sloughing machines as described for example in German Pat. No. 26 54 593.

Such a valve control is to be suitable also for the control of the valves in sloughing machines in which an inlet process does not regularly follow an outlet process (or vice versa), but in which for example, in every sloughing phase several separate positive sloughing strokes are produced and only thereafter the air outlet takes place.

Accordingly, another object of the invention is to provide a method of electronically controlling the sloughing strokes of a wet sloughing machine having inlet and outlet valves that are opened and closed by command pulses, comprising generating recurrent signal codes having a stroke frequency, operating an inlet sloughing stroke generator and an outlet sloughing stroke generator in parallel, using the signal codes, to generate command pulses for the inlet and outlet valves, power amplifying the command pulses before they are applied to the inlet and outlet valves, dividing the signal codes according to a selected clock sequence to form divided signal codes, and influencing the formation of the command pulses from the outlet sloughing stroke generator, according to the divided signal codes.

A further object of the invention is to provide an apparatus for electronically controlling the sloughing strokes of the wet sloughing machine which comprises a freely adjustable stroke frequency generator for generating a signal code, an inlet sloughing stroke generator for receiving the signal code to produce command pulses for an inlet valve of the sloughing machine, a divisor connected to the stroke frequency generator for dividing the signal codes by an adjustable amount to form divided signal codes, outlet sloughing stroke generator means connected to the divisor for producing command pulses according to the divided signal codes to operate an outlet valve, and power amplifiers for amplifying the control pulses of the inlet sloughing stroke generator and the outlet sloughing stroke generator means to operate the inlet and outlet valves.

According to the invention, the outlet sloughing stroke generator means may comprise a stroke generator which directly receives the divided signal codes. The stroke generator means may also include an AND gate for receiving a command pulse from the stroke generator proper, and having another input for receiving the divided signal code, the AND gate producing an output which is amplified by the power amplifier for controlling the outlet valve.

The output of the divisor can also be combined with the output of the frequency generator through the inverting input of another AND gate which is designed to have one inverting input.

A further object of the invention is to provide an apparatus for electronically controlling the sloughing strokes of a wet sloughing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
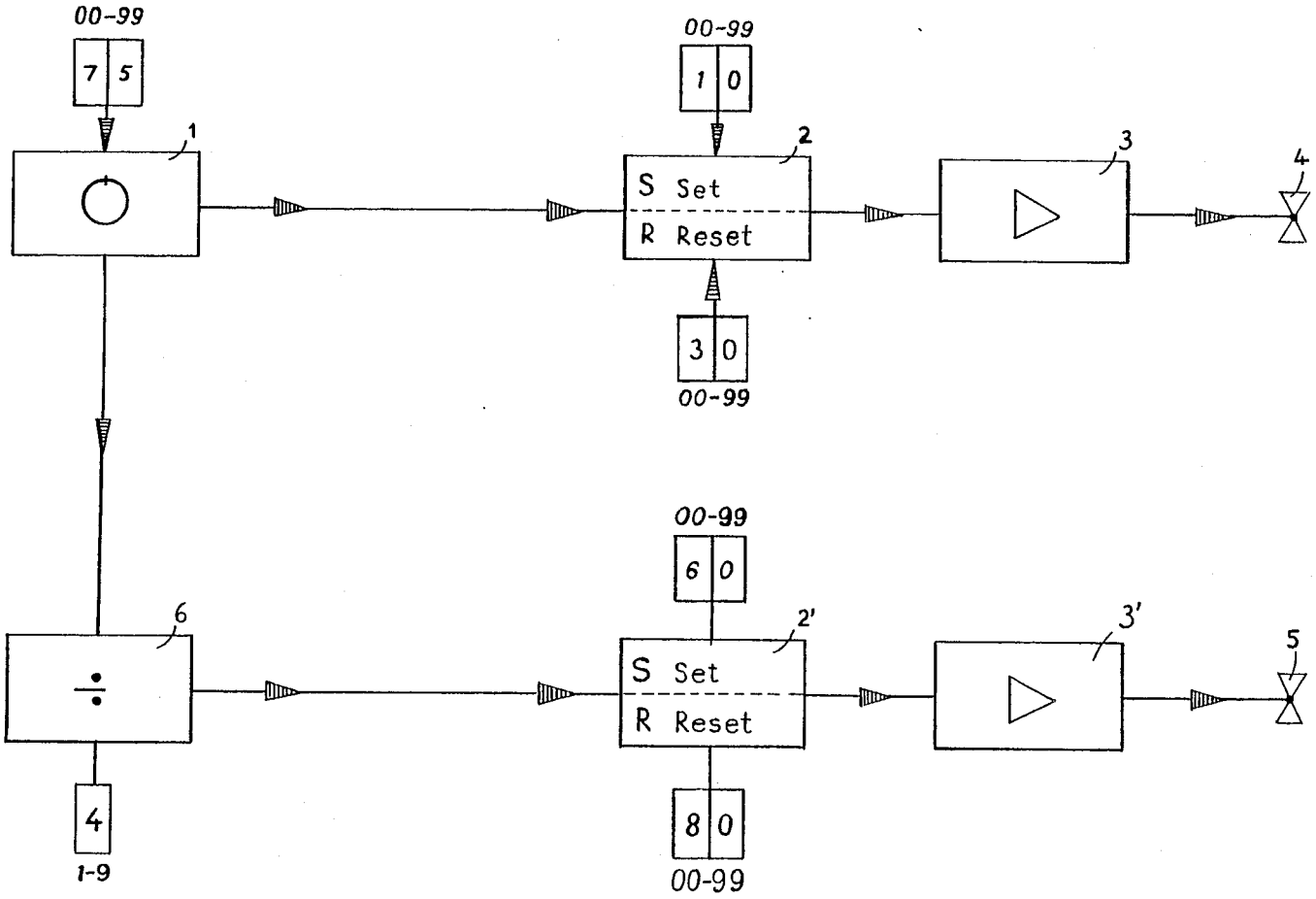
FIG. 1 is a block diagram showing the electronic valve control of the present invention.

Referring to the drawings in particular, the invention embodied in FIG. 1 comprises an apparatus for electronically controlling the sloughing strokes of a wet sloughing machine for coal and other minerals, which includes a stroke frequency generator 1 which is connected parallel to an inlet sloughing stroke generator 2 and an outlet sloughing stroke generator 2'. The sloughing stroke generators 2 and 2' produce command pulses which are amplified and then applied to inlet and outlet valves 4 and 5 respectively.

The stroke frequency generator 1 serves to generate a stroke or clock frequency. The clock frequency is freely adjustable between 00–99 pulses per minute. In each clock time a signal code of 00–99 is generated.

According to FIG. 1, the clock frequency of the stroke frequency generator 1 is 75 strokes per minute.

The signal code is conducted out of the stroke frequency generator 1 to the inlet sloughing stroke generator or inlet pulser 2 as well as to a divisor 6, in parallel. At the inlet pulser 2, the code is polled (interrogated) and evaluated. Three coding switches, located in pairs on the fore front of the sloughing stroke generator 2, make it possible to evaluate the signal code betwen 00–99, in a freely adjustable manner. The upper decoding switch marked "SET," of pulser 2 is closed for actuation of the amplifier 3, i.e. for power connection (inlet valve to be switched). The lower decoding switch marked "RESET", causes the resetting of the power pulse i.e. remove voltage and hence switch inlet valve back to the old state). The power amplifier 3, which is connected between the inlet pulser 2 and inlet valve 4, acts on the inlet valve 4.

The outlet pulser 2' depends, as to clock frequency, on the divisor 6. The divisor 6 has the function to determine the outlet clock frequency depending on the ratio which is freely selected between 1–9, to the inlet clock frequency.

In the example according to FIG. 1, the divisor 6 has a setting "4", i.e. only with every fourth clock pulse the signal code is stepped on to the outlet pulser 2', so that the time dependence between the inlet valve 4 and the outlet valve 5 is ensured at any clock frequency and at any adjusted ratio.

As a variant of the circuit example according to FIG. 1, the inlet pulser 2, outlet pulser 2' and divisor 6 can be connected in parallel with the stroke frequency generator 1. This is evident from the example according to FIG. 2.

In this circuit, the divisor 6 releases, according to a freely selectable clock sequence, the command pulse which comes from the outlet pulser 2' and is to go to the outlet valve 5 either before the power amplifier 3', in the amplifier 3' or after the amplifier 3'.

In the example shown (FIG. 2) the divisor 6 has the setting "4" as in FIG. 1. In the circuit according to FIG. 2, the power pulse from the outlet pulser 2' is released only at every fourth clock pulse from the frequency generator 1. The release occurs via an AND gate 7. In the embodiment, the AND gate 7 is connected between outlet pulser 2' and power ampifier 3'.

Figure 3:
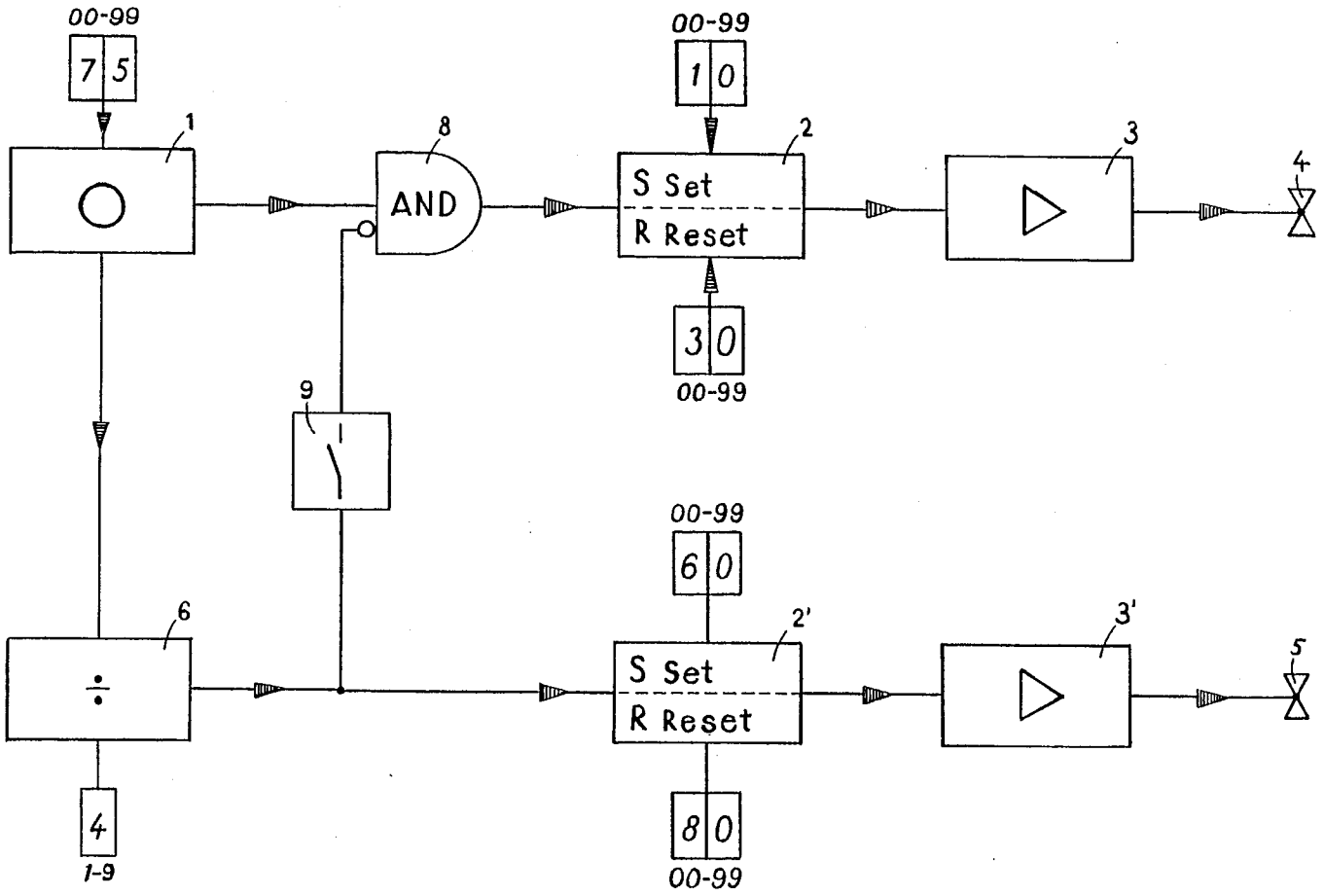
FIG. 3 is a view similar to FIG. 2 showing a still further embodiment of the invention.

To prolong the opening period of the outlet valve 5 without having this period overlap with the opening period of inlet valve 4, according to FIG. 3, as distinguished from FIG. 1, an AND gate 8 is connected between stroke frequency generator 1 and inlet pulser 2.

The AND gate 8 receives a negating input from divisor 6. This input can, if necessary, be separated via a switch 9. To this end, AND gate 8 is specially designed to have one inverting input connected to the divisor 6 via the switch 9.

Figure 2:
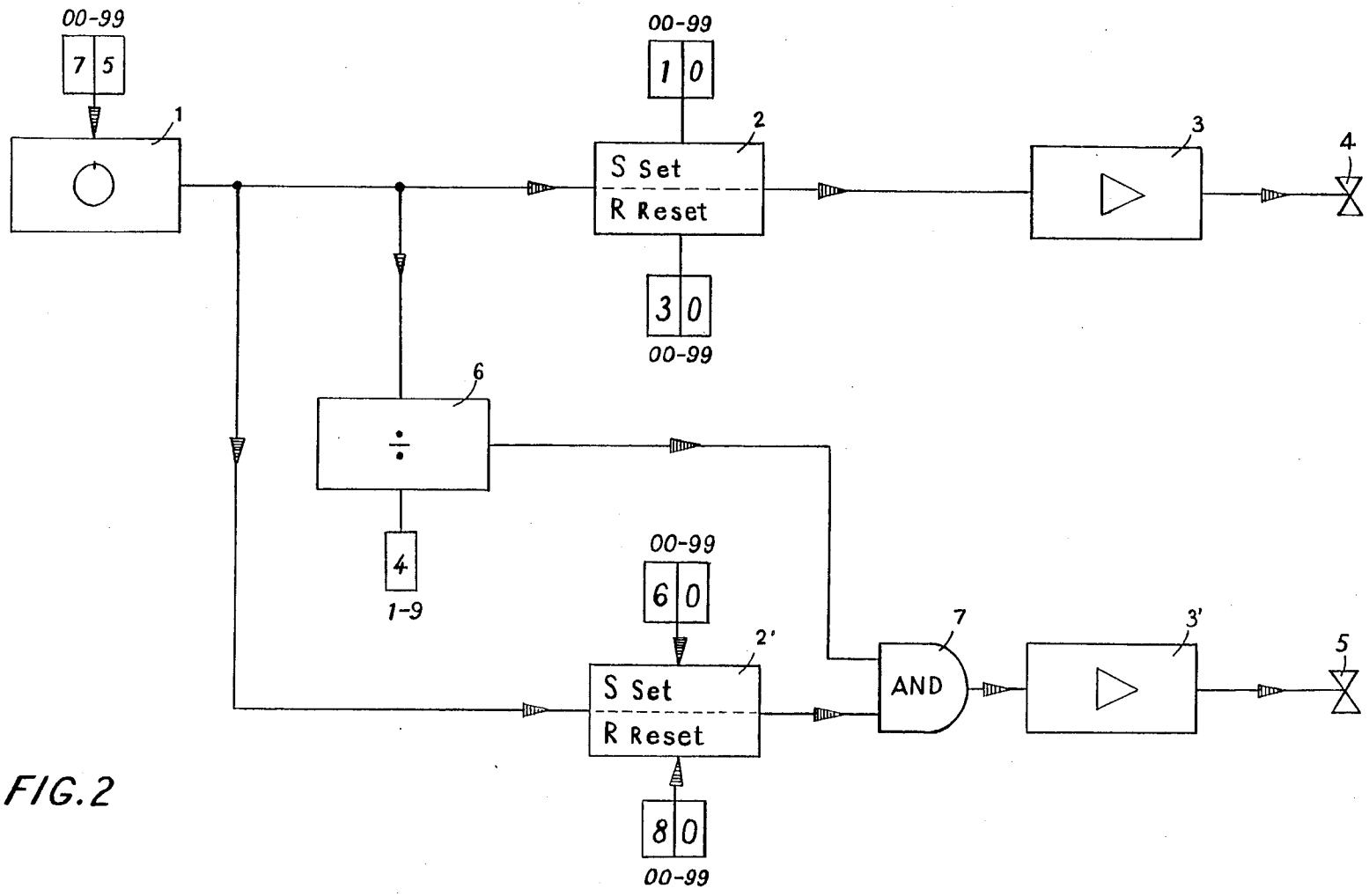
FIG. 2 is a view similar to FIG. 1 showing another embodiment of the invention.
Figure 4:
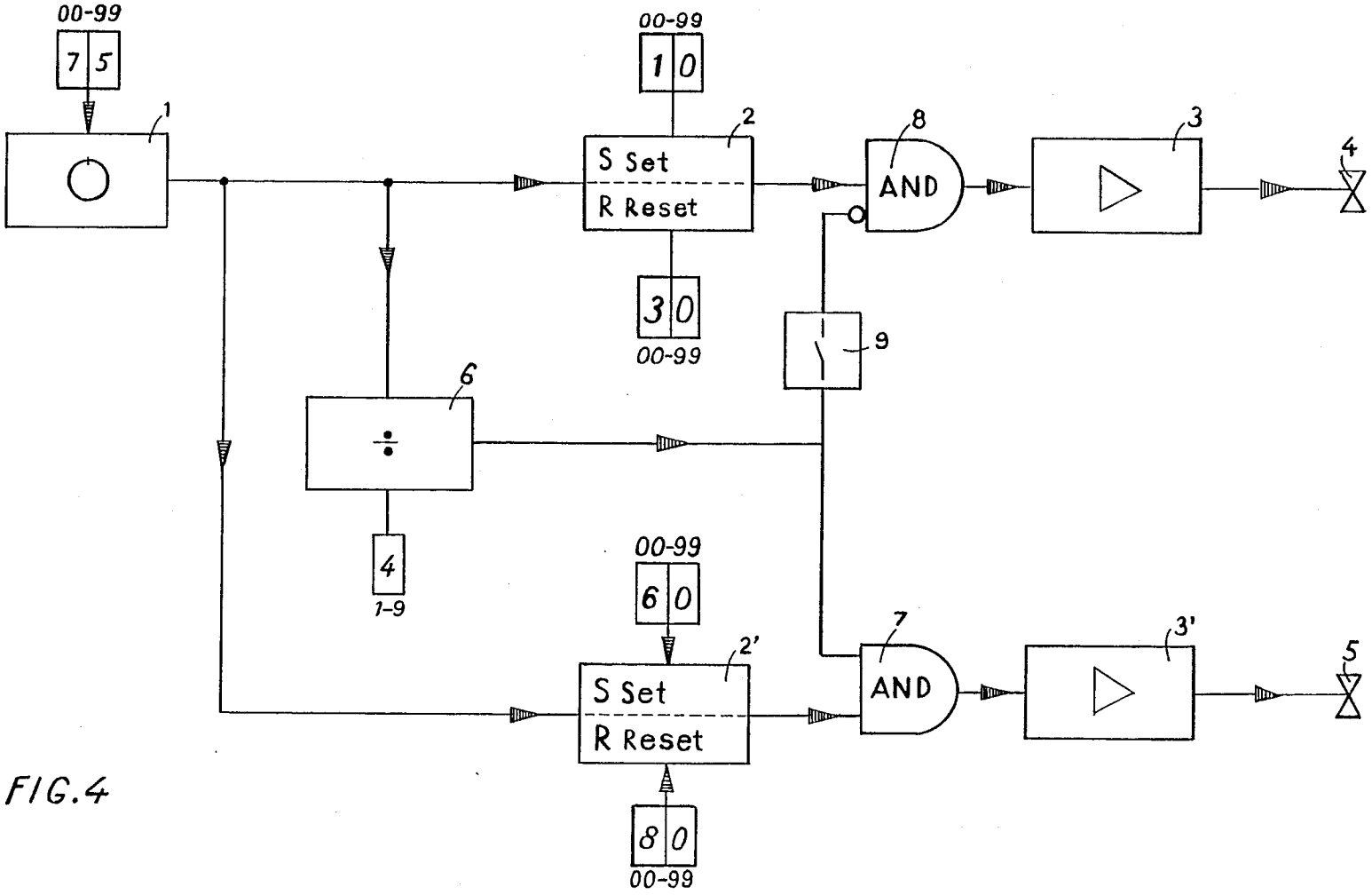
FIG. 4 is a view similar to FIG. 3 showing a fourth embodiment of the invention.

For the same purpose, i.e. to avoid an overlap of the opening periods of valves 4 and 5, according to FIG. 4, as distinguished from FIG. 2, an AND gate 8 which receives a negating input from divisor 6 is connected between inlet pulser 2 and power amplifier 3. Here also the connection can be separated by a switch 9.

The invention thus is a method for electronically controlling the sloughing strokes of a wet sloughing machine having inlet and outlet valves 4,5, that are opened and closed by command pulses, comprising generating recurrent signal codes having a stroke frequency, operating an inlet sloughing stroke generator 2 and an outlet sloughing stroke generator 2' in parallel using the signal codes, to generate command pulses for the inlet and outlet valves 4,5, dividing the signal codes according to a selected clock sequence to form divided signal codes and influencing the formation of the command pulses from the outlet sloughing stroke generator according to the divided signal codes.

The invention is also an apparatus for electronically controlling the sloughing strokes of a wet sloughing machine having inlet and outlet valves, 4,5 that are opened and closed by command pulses, comprising a stroke frequency generator for generating recurrent signal codes having an adjustable stroke frequency, an inlet sloughing stroke generator 2 connected to said stroke frequency generator for producing command pulses, a first power amplifier connected to the inlet sloughing stroke generator for amplifying the command pulses for use in controlling the inlet valve, a divisor connected to the stroke frequency generator for dividing the signal codes by an adjustable factor to form a divided signal code, and outlet sloughing stroke generator means connected to the divisor for producing command pulses according to the divided signal code.

While specific embodiments of the invention have been shown and described in detail to illustrate the application of the principles of the invention, it will be understood that the invention may be embodied otherwise without departing from such principles.

What is claimed is:

1. A method of electronically controlling the sloughing strokes of a wet sloughing machine having inlet and outlet valves that are opened and closed by respective command pulses, comprising generating recurrent signal codes that are adjustable to represent an adjustable stroke frequency, operating an inlet sloughing stroke generator as a function of the signal codes to generate command pulses for the inlet valve, dividing the signal codes according to a selected clock sequence to form divided signal codes, operating an outlet sloughing stroke generator as a function of the signal codes to generate command pulses for the outlet valve, and influencing the formation of the command pulses for the outlet valve according to the divided signal codes.

2. A method according to claim 1, wherein said outlet valve command pulses are formed by supplying the divided signal codes to an input of the outlet sloughing stroke generator.

3. A method according to claim 2, including supplying the recurrent signal codes to a non-inverting input of an AND gate having inverting and non-inverting inputs and supplying the divided signal codes to the inverting input of the AND gate, the AND gate having an output connected to the inlet sloughing stroke generator, whereby the recurrent signal codes are selectively blocked by the divided signal codes to interrupt operation of the inlet sloughing stroke generator.

4. A method according to claim 3, including switching application of the divided signal codes on and off to the inverting input.

5. A method according to claim 1, wherein said outlet valve command pulses are formed by supplying the recurrent signal codes to an input of the outlet sloughing stroke generator to produce output pulses, supplying the output pulses to one input of an AND gate, supplying the divided signal codes to another input of the AND gate, the AND gate having an output which carries the command pulses for the outlet valve.

6. A method according to claim 5, including supplying output pulses from the inlet sloughing stroke generator to a non-inverting input of a further AND gate having inverting and non-inverting inputs, supplying the divided signal codes to the inverting input of the further AND gate, the output of the further AND gate being amplified to form the command pulses for the inlet valve, whereby the output pulses from the inlet sloughing stroke generator are selectively interrupted by the divided signal codes.

7. A method according to claim 6, including switching application of the divided signal codes on and off to the inverting input.

8. An apparatus for electronically controlling the sloughing strokes of a wet sloughing machine having inlet and outlet valves that are opened and closed by respective command pulses, comprising a stroke frequency generator for generating recurrent signal codes adjustable to represent an adjustable stroke frequency, an inlet sloughing stroke generator operatively connected to said stroke frequency generator for producing output pulses, a power amplifier operatively connected to said inlet sloughing stroke generator for amplifying the output pulses to produce said command pulses for controlling the inlet valve, a divisor connected to said stroke frequency generator for dividing the signal codes by an adjustable factor to form divided signal codes, outlet valve command pulse generator means connected to said divisor for receiving the divided signal codes to form control pulses, and a further power amplifier connected to said outlet valve command pulse generator means for amplifying the control pulses to produce said command pulses for controlling the outlet valve.

9. An apparatus according to claim 8, wherein said outlet valve command pulse generator means comprises an outlet sloughing stroke generator having an input for receiving the divided signal codes from said divisor and an output for applying said controls pulses to said further power amplifier.

10. An apparatus according to claim 9, including an AND gate having a non-inverting input connected to said stroke frequency generator for receiving the recurrent signal codes, said AND gate having an output connected to said inlet sloughing stroke generator, said AND gate also having an inverting input operatively connected to said divisor for receiving the divided signal codes for blocking application of the recurrent signal codes to said inlet sloughing stroke generator according to the divided signal codes.

11. An apparatus according to claim 10, including a switch connected between said divisor and said inverting input for selectively applying the divided signal codes thereto.

12. An apparatus according to claim 8, wherein said outlet valve command pulse generator means comprises an outlet sloughing stroke generator having an input for receiving recurrent signal codes from said stroke frequency generator, and an AND gate having a first input connected to an output of said outlet sloughing stroke generator, said divisor connected to another input of said AND gate for applying said divided signal codes to said other input of said AND gate, said AND gate having an output connected to said further power amplifier.

13. An apparatus according to claim 12, including a further AND gate having a non-inverting input connected to said inlet sloughing stroke generator for receiving output pulses therefrom, and an output connected to said power amplifier, said further AND gate having an inverting input operatively connected to said divisor for receiving said divided signal codes for blocking said output pulses of said inlet sloughing stroke generator according to the dividing signal codes.

14. An apparatus according to claim 13, including a switch connected between said divisor and said inverting input for selectively applying the divided signal codes thereto.

15. A method of electronically controlling the sloughing strokes of a wet sloughing machine having inlet and outlet valves that are opened and closed by respective command pulses, comprising generating recurrent signal codes that are adjustable to represent an adjustable stroke frequency, operating an inlet sloughing stroke generator and an outlet sloughing stroke generator in parallel using the signal codes to generate the respective command pulses for the inlet and outlet valves, dividing the signal codes according to a selected clock signal to form divided signal codes, and influencing the formation of the command pulses from the outlet sloughing stroke generator according to the divided signal codes.

* * * * *